US011134326B2

(12) United States Patent
Johnson

(10) Patent No.: US 11,134,326 B2
(45) Date of Patent: Sep. 28, 2021

(54) MOUTHGUARDS AND METHODS OF USE

(71) Applicant: Guy R. Johnson, Covington, GA (US)

(72) Inventor: Guy R. Johnson, Covington, GA (US)

( * ) Notice: Subject to any disclaimer, the term of this patent is extended or adjusted under 35 U.S.C. 154(b) by 0 days.

(21) Appl. No.: 16/841,205

(22) Filed: Apr. 6, 2020

(65) Prior Publication Data

US 2020/0322708 A1 Oct. 8, 2020

Related U.S. Application Data

(60) Provisional application No. 62/830,132, filed on Apr. 5, 2019.

(51) Int. Cl.
*H04R 1/08* (2006.01)
*H04R 1/22* (2006.01)

(52) U.S. Cl.
CPC ..... *H04R 1/083* (2013.01); *H04R 1/086* (2013.01); *H04R 1/222* (2013.01); *H04R 2201/02* (2013.01)

(58) Field of Classification Search
CPC ..... H04R 1/086; H04R 1/083; H04R 1/1091; H04R 1/08; H04R 1/028; H04K 3/68; H04M 1/6058
See application file for complete search history.

(56) References Cited

U.S. PATENT DOCUMENTS

| | | | |
|---|---|---|---|
| D201,267 | S | 6/1965 | Gentile |
| D214,919 | S | 8/1969 | Moberger |
| 3,478,799 | A | 11/1969 | Hoyt, Jr. |
| D291,714 | S | 9/1987 | Spiegel |
| 5,533,131 | A | 7/1996 | Kury |
| 5,682,424 | A | 10/1997 | Alcorn, Sr. |
| D392,705 | S | 3/1998 | Spiegel |
| D455,891 | S | 4/2002 | Biedrzycki |
| 6,510,311 | B1 | 1/2003 | Stitt |
| D507,348 | S | 7/2005 | Moore |
| 6,935,458 | B2 | 8/2005 | Owens |
| D534,065 | S | 12/2006 | Andre |
| D537,488 | S | 2/2007 | Mazloompour |
| 7,783,034 | B2 | 8/2010 | Manne |
| D676,828 | S | 2/2013 | Clark |
| 8,437,491 | B2 | 5/2013 | Ward |
| D724,791 | S | 3/2015 | Cram |
| 8,996,382 | B2 | 3/2015 | McClung, III |
| D726,970 | S | 4/2015 | Martin |
| D731,459 | S | 6/2015 | Paslawski |
| 9,241,208 | B2 | 1/2016 | Ball |
| D770,691 | S | 11/2016 | Bayer |
| 9,525,765 | B2 | 12/2016 | Moser |
| D778,431 | S | 2/2017 | Glickfield |
| 9,614,945 | B1 | 4/2017 | Moser |
| D813,202 | S | 3/2018 | Johnson |
| 10,172,398 | B2 | 1/2019 | Saco |
| 2008/0134402 | A1 | 6/2008 | Bailey |
| 2008/0304690 | A1 | 12/2008 | Poindexter |
| 2010/0034412 | A1 | 2/2010 | Parda |
| 2016/0255432 | A1 | 9/2016 | Casso Villareal |

*Primary Examiner* — Kile O Blair
(74) *Attorney, Agent, or Firm* — Todd Allen Serbin; Nexsen Pruet, LLC

(57) ABSTRACT

A mouthguard apparatus for providing confidential communications for a user of a headset, comprising: a body of unitary construction, wherein the body includes a) a lumen traversing from a side of the body at least to midway through the body, wherein the lumen extends past midway through the body, and b) a curved indentation disposed on a back of the body, wherein the indentation is concave relative to the body.

18 Claims, 19 Drawing Sheets

MOUTHGUARDS AND METHODS OF USE

RELATED APPLICATION

This application claims the benefit of priority under 35 U.S.C. § 119(e) of U.S. Provisional Patent Application No. 62/830,132 filed Apr. 5, 2019, the contents of which are incorporated herein by reference in its entirety.

FIELD AND BACKGROUND OF THE INVENTION

The present invention, in some embodiments thereof, relates to the communications field and, more particularly, but not exclusively, to confidential communications.

Currently, coaches hold up a clipboard or use their hand to cover their lips while they are trying to maintain the confidentiality of their conversations.

SUMMARY OF THE INVENTION

According to an aspect of some embodiments of the present invention there is provided a mouthguard apparatus for providing confidential communications for a user of a headset, comprising: a body of unitary construction, wherein the body includes a) a lumen traversing from a side of the body at least to midway through the body, wherein the lumen extends past midway through the body, and b) a curved indentation disposed on a back of the body, wherein the indentation is concave relative to the body.

In an embodiment of the invention, the body further includes a flat front fascia on a side opposite the curved indentation.

In an embodiment of the invention, the mouthguard further comprises text and/or at least one design on the flat front fascia.

In an embodiment of the invention, the flat front fascia is a solid color.

In an embodiment of the invention, the mouthguard further comprises at least one dimple on a top and/or a bottom of the body, extending generally transverse to the indentation on the back of the body.

In an embodiment of the invention, the body is shaped like at least one of a football, a rugby ball, a sphere, a rectangle, an ovoid and a cube.

In an embodiment of the invention, the body is made from a compressible and/or elastic material.

In an embodiment of the invention, the body is made from a urethane-based material.

In an embodiment of the invention, a cross-section of the lumen is circular, triangle, square, rectangular, ovoid or irregularly shaped.

In an embodiment of the invention, the lumen has a diameter between 6 mm and 20 mm.

In an embodiment of the invention, the body has a length of 100 mm-150 mm.

In an embodiment of the invention, the body has a width of 40 mm-90 mm.

According to a further aspect of some embodiments of the present invention there is provided a mouthguard apparatus for providing confidential communications for a user of a headset, comprising: a body sized and shaped to substantially cover a mouth of the user; a cavity disposed within the body; and, a lumen disposed on a side of the body and passing through to the cavity from the side.

In an embodiment of the invention, the mouthguard apparatus further comprises an attachment mechanism.

In an embodiment of the invention, the mouthguard apparatus a removable rear portion.

In an embodiment of the invention, the mouthguard apparatus a tray sized and shaped for insertion into the cavity.

In an embodiment of the invention, the tray further comprises a cut-out positioned proximally to the lumen when inserted into the cavity.

In an embodiment of the invention, the body includes at least one of text and a design on the front.

In an embodiment of the invention, the mouthguard apparatus at least one feature within the cavity shaped and sized to enhance acoustics within the cavity and/or hold a portion of the headset securely.

According to a further aspect of some embodiments of the present invention there is provided a method of using a mouthguard apparatus with a headset including a microphone on a microphone boom, comprising: positioning the mouthguard apparatus proximally to the communications headset, such that a lumen of the mouthguard apparatus is near the microphone boom; and then optionally either a) sliding the mouthguard apparatus onto the microphone boom, and, advancing the microphone boom into the mouthguard apparatus such that the microphone is located within a cavity of the mouthguard apparatus, or, b) removing a rear portion of the mouthguard apparatus, placing the microphone boom within the lumen such that the microphone is disposed within the cavity, securing an attachment mechanism around the boom, re-attaching the rear portion to the mouthguard apparatus; and, using the headset.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example, are not necessarily to scale, and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
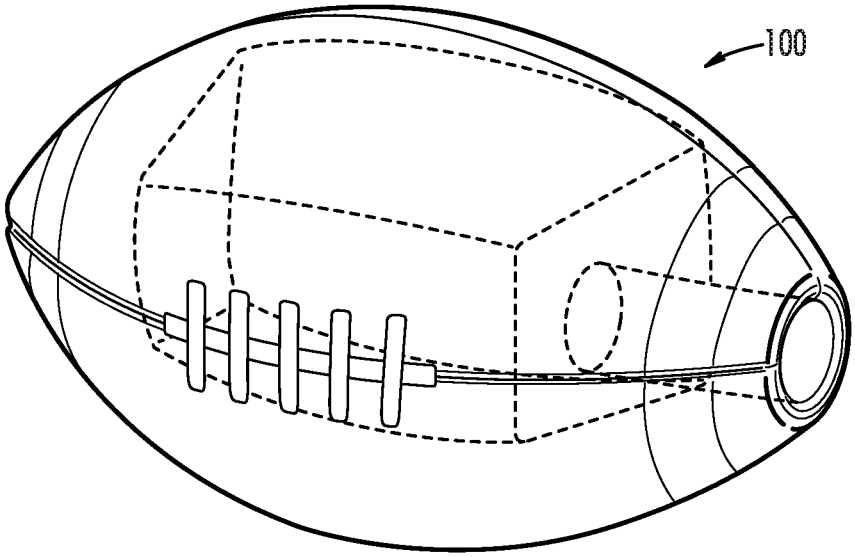
FIG. 1 is a perspective view of a mouthguard apparatus, in accordance with an exemplary embodiment of the invention.

The present invention, in some embodiments thereof, relates to the communications field and, more particularly, but not exclusively, to confidential communications.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Generally, the mouthguard apparatuses described herein are designed, configured and intended to prevent people from reading the lips of the user, for example a coach, while speaking into a communications device, like a microphone headset. That is, the mouthguards described herein provide a physical shield to block the whole mouth, or at least a significant portion thereof, in order to maintain communications confidentiality. It also serves the function of providing better sound quality for communications by blocking wind, screening out game/crowd/background noise, and/or creating an acoustic chamber for the user's voice. Furthermore, the mouthguards described herein provide a measure of thermal protection to the user, for example by keeping the lower face warm in cold weather.

In some fields of use for the mouthguards described herein, certain of the advantages are more useful than others. For example, in a call-center type application, it is more useful that the mouthguards described herein block background noise and/or provide for better voice acoustics for the user than having thermal protection.

Referring to FIG. 1 is a perspective view of a mouthguard apparatus 100, in accordance with an exemplary embodiment of the invention. In an embodiment, the mouthguard apparatus 100 is generally shaped and configured like a football, with some modifications as described in more detail herein. However, it should be understood that the apparatus 100 could exhibit any shape, for example as shown in FIG. 13, as long as it was large or sufficient enough to wholly, or substantially, block the mouth of the user. Blocking includes the front of the user's mouth especially, but also the top, bottom, and sides of the user's lips, in some embodiments of the invention.

In some embodiments, the apparatus is made from any material which can achieve the functions described herein, in particular, visually blocking the user's mouth, screening out wind and/or filtering out noise. Exemplary materials of construction include paper, plastic, foam, sponge, cardboard, cloth, screen, wood, and/or metal. In some embodiments, the apparatus 100 is of unitary construction, for example being a single piece formed or molded or cast. In some embodiments of the invention, the material is compressible and/or elastic.

In some embodiments, the apparatus 100 is intended to be one-time use (i.e disposable) and is therefore easily manufactured (for example by being of unitary construction), simple to attach/detach (for example, using a slide on/off compression fit for securing the apparatus 100 onto a microphone boom) and/or is constructed from an inexpensive material such as lightweight and/or soft material such as a urethane-based cellular material or a functional equivalent.

In some embodiments, the apparatus 100 includes surface text and/or designs such as team logos, the features of a specific ball associated with a specific sport (e.g. a football), advertising, text and/or graphics. In some embodiments of the invention, the surface (where the football laces are shown in FIG. 1) is adapted for logos and/or advertising, for example by being flattened such as shown in FIGS. 17-21E and/or by being provided with a green color for use with green-screening technology for showing advertising on the surface during video broadcast and/or recording. Optionally, the advertising can be changed on the fly utilizing green-screen technology.

Figure 2:
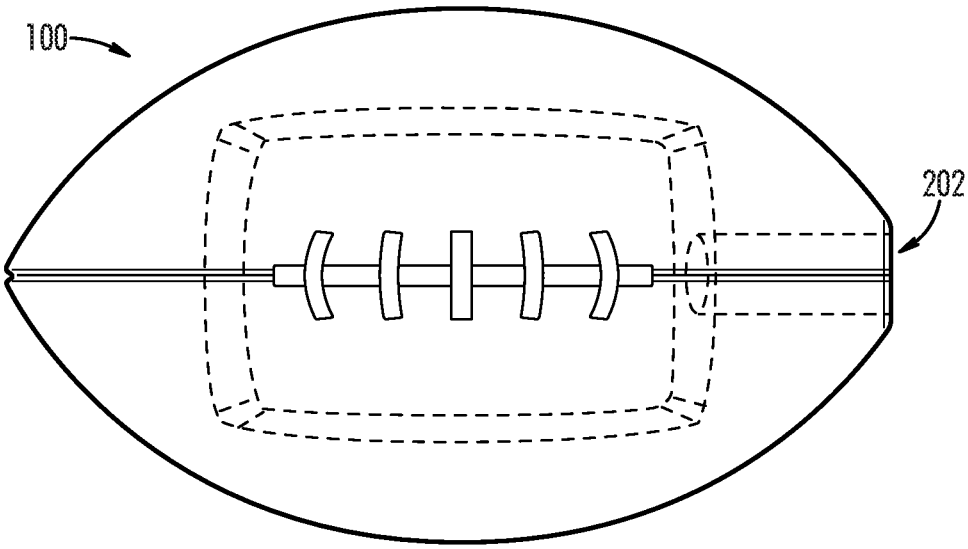
FIG. 2 is a front view of the mouthguard apparatus of FIG. 1, in accordance with an exemplary embodiment of the invention.
Figure 9:
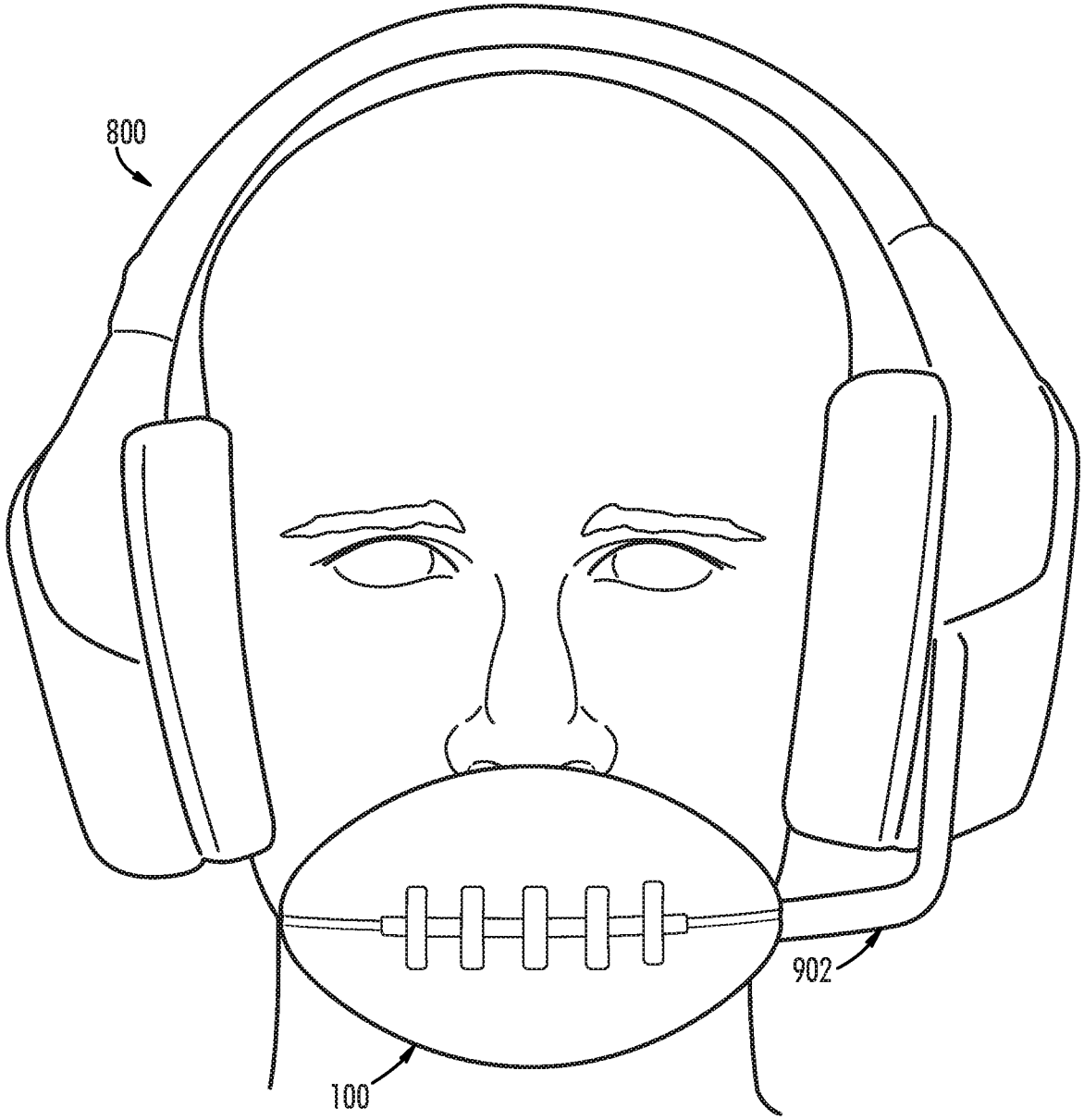
FIG. 9 is a front view of a mouthguard apparatus of FIG. 1 in an exemplary use, in accordance with an exemplary embodiment of the invention.

FIG. 2 is a front view of the mouthguard apparatus 100, in accordance with an exemplary embodiment of the invention. In some embodiments of the invention, a lumen 202 is disposed on one side of, and through, the apparatus 100 into a cavity 302, shown and described in more detail with respect to FIG. 3. The lumen 202 is sized and configured to receive therethrough a microphone boom 902, such as shown in FIG. 9. In an embodiment of the invention, the cross-section of the lumen 202 is substantially circular shaped. Optionally, the cross-section of the lumen is shaped like a square or a triangle. Optionally, the cross-section of the lumen is ovoid or rectangular. In some embodiments of the invention, the lumen is custom shaped to a specific type of microphone boom. In an embodiment of the invention, the apparatus 100 (and any of the apparatuses 1700, 1900, 2100 described herein) is approximately 100 mm-150 mm in the longitudinal axis. In some embodiments of the invention, the apparatus 100 is approximately 40 mm-65 mm in the maximum width dimension (from apex to apex of the curved ball shape in the minor axis). In some embodiments of the invention, the lumen is no more than 90 mm long. In some embodiments of the invention, there is no cavity 302 separate from the lumen 202, and the microphone boom extends into the lumen 202 solely, where the lumen 202 extends at least some length into the main body of the apparatus 100. It should be understood that because the apparatuses described herein are intended to fully cover the user's mouth the dimensions given herein could be critical, depending on the user and the intended use of the apparatuses.

Figure 3:
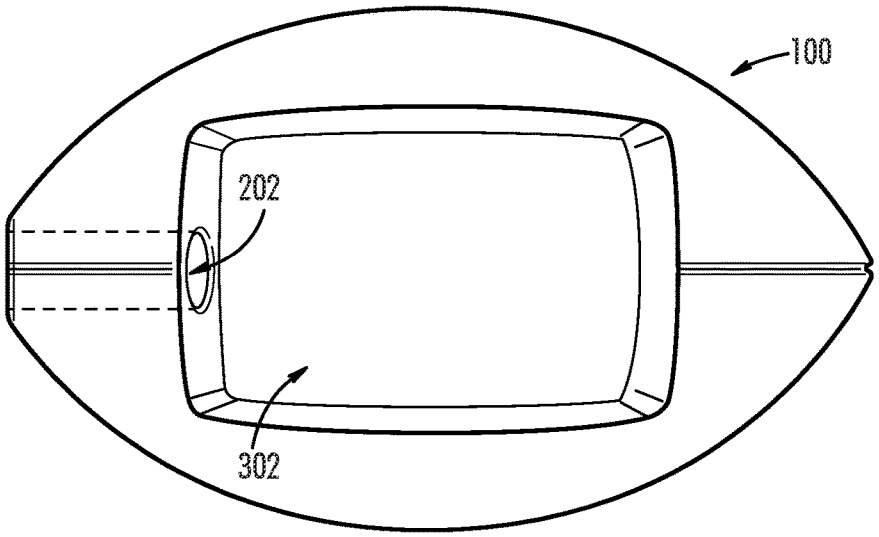
FIG. 3 is a rear view of the mouthguard apparatus of FIG. 1, in accordance with an exemplary embodiment of the invention.

FIG. 3 is a rear view of the mouthguard apparatus 100, in accordance with an exemplary embodiment of the invention. Shown from this view is the cavity 302 carved out of the apparatus 100 which, in nominal use, faces the mouth of the user. In some embodiments of the invention, the cavity is lined with a tray 1500 such as shown in FIGS. 15A-15E. In some embodiments of the invention, a portion of the apparatus 100, for example, a rear portion is reversibly removable from the main body of the apparatus 100 to enable access to various attachment mechanisms, described elsewhere herein, and/or the microphone boom 902 and/or the cavity 302.

Figure 4:
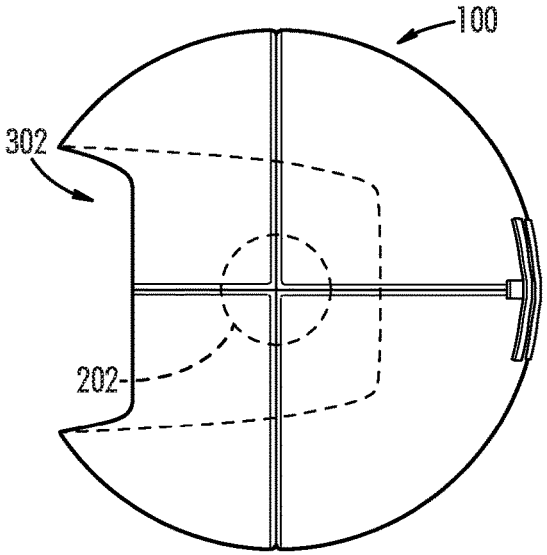
FIG. 4 is a left view of the mouthguard apparatus of FIG. 1, in accordance with an exemplary embodiment of the invention.
Figure 5:
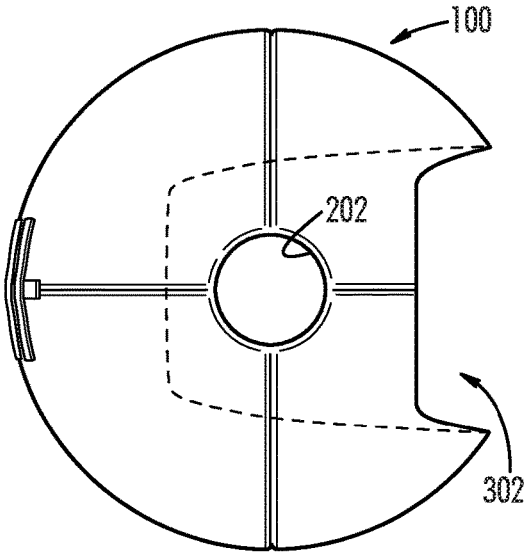
FIG. 5 is a right view of the mouthguard apparatus of FIG. 1, in accordance with an exemplary embodiment of the invention.

FIG. 4 is a left view of the mouthguard apparatus 100, in accordance with an exemplary embodiment of the invention. While this is described as the "left" side view, it should be understood that the lumen 202 could be positioned on either or both sides of the apparatus 100. FIG. 5 is a right side view of the mouthguard apparatus 100, in accordance with an exemplary embodiment of the invention.

Figure 6:
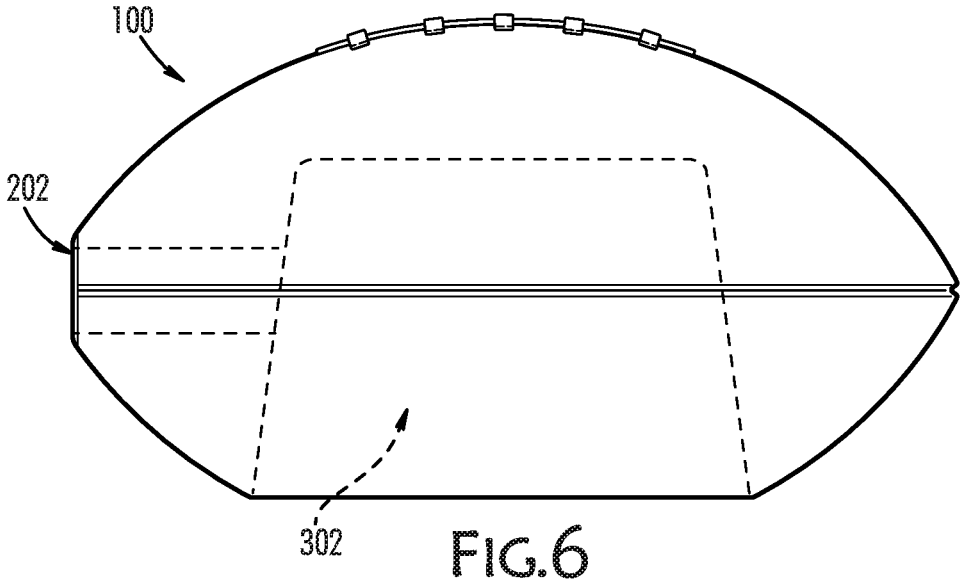
FIG. 6 is a top view of the mouthguard apparatus of FIG. 1, in accordance with an exemplary embodiment of the invention.
Figure 7:
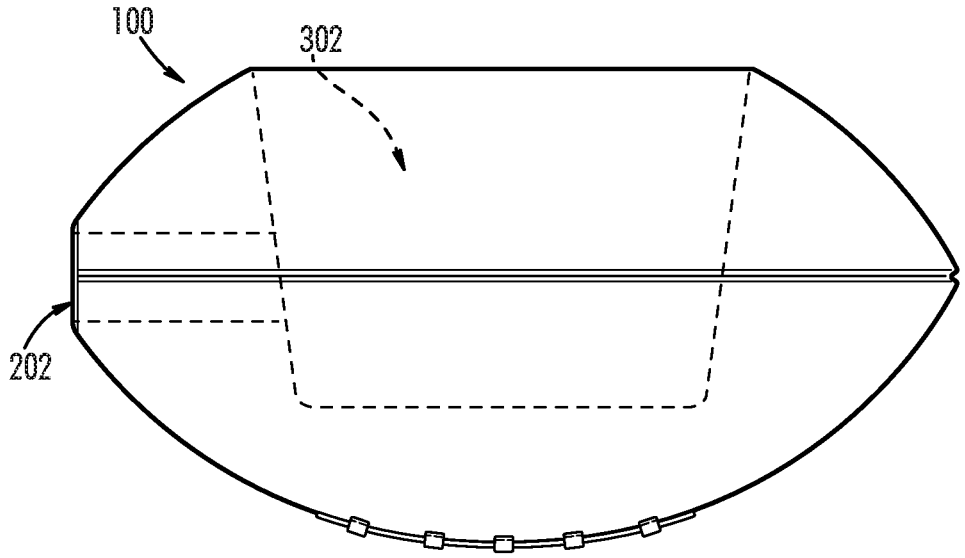
FIG. 7 is a bottom view of the mouthguard apparatus of FIG. 1, in accordance with an exemplary embodiment of the invention.

FIG. 6 is a top view of the mouthguard apparatus 100, in accordance with an exemplary embodiment of the invention. FIG. 7 is a bottom view of the mouthguard apparatus 100, in accordance with an exemplary embodiment of the invention. In some embodiments of the invention, the cavity 302 is a substantial cut out portion of the apparatus 100. However, in some embodiments, the cavity 302 is smaller and/or does not resect as much of the curvature of the apparatus 100 as is shown in FIGS. 6 and 7.

Figure 8:
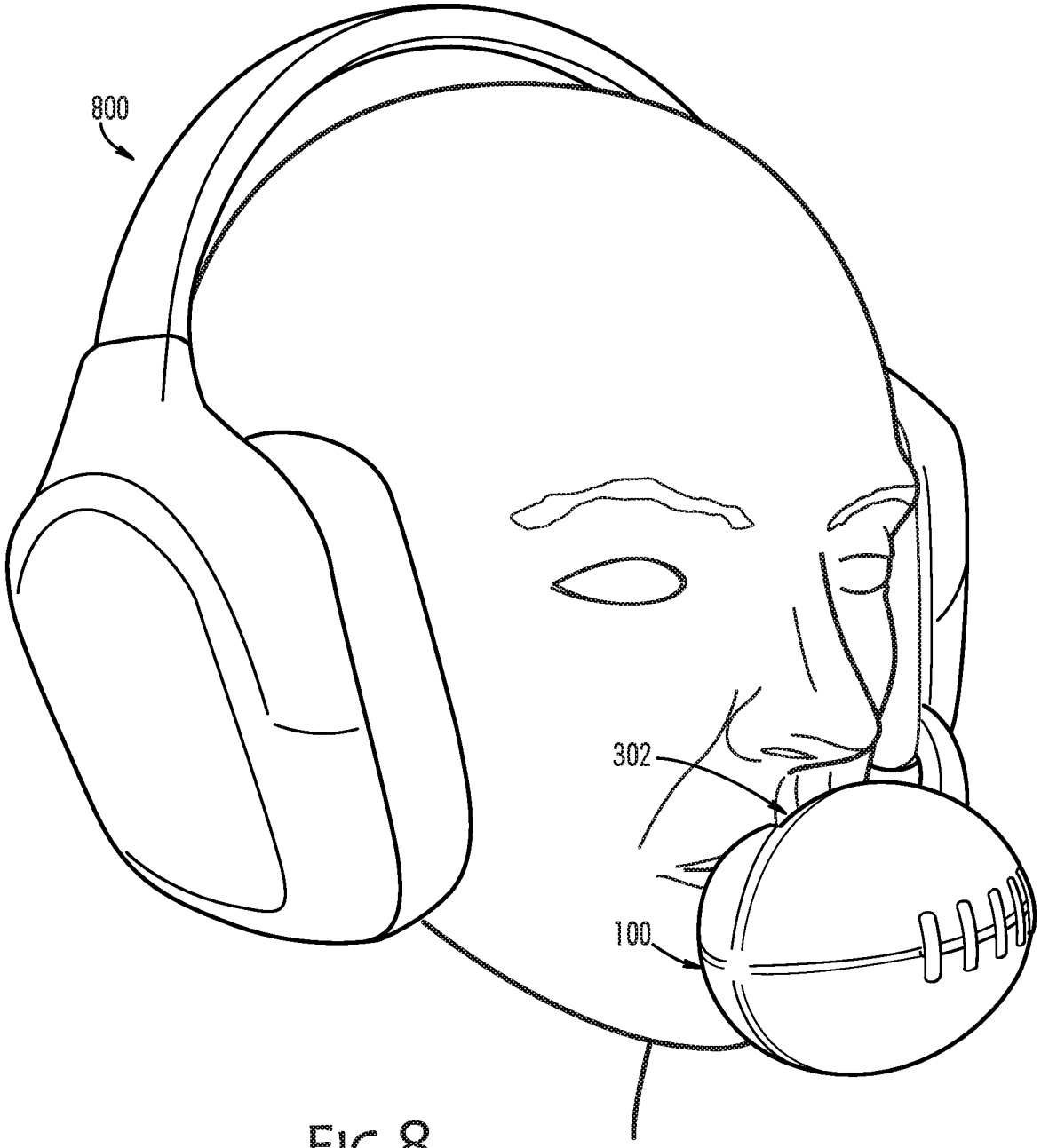
FIG. 8 is a perspective view of a mouthguard apparatus of FIG. 1 in an exemplary use, in accordance with an exemplary embodiment of the invention.

FIG. 8 is a perspective view of the mouthguard apparatus 100 in an exemplary use with a typical communications headset 800, in accordance with an exemplary embodiment of the invention.

FIG. 9 is a front view of the mouthguard apparatus 100 in an exemplary use where the microphone boom 902 is shown inserted into the lumen 202 of the apparatus 100, in accordance with an exemplary embodiment of the invention.

Figure 10:
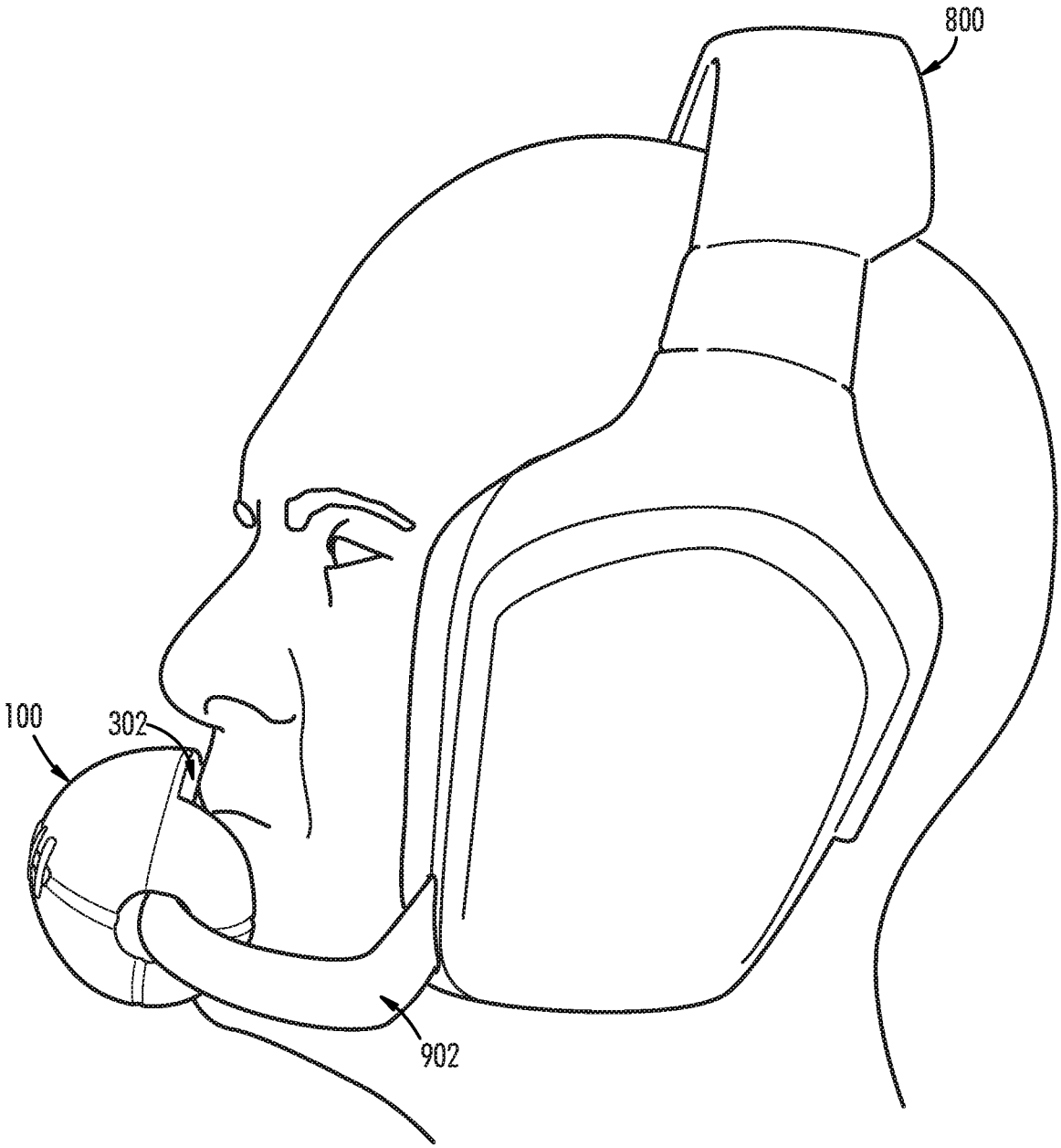
FIG. 10 is a left view of a mouthguard apparatus of FIG. 1 in an exemplary use, in accordance with an exemplary embodiment of the invention.

FIG. 10 is a left view of the mouthguard apparatus 100 in an exemplary use where the microphone boom 902 is shown inserted into the lumen 202 of the apparatus 100, in accordance with an exemplary embodiment of the invention.

Figure 11:
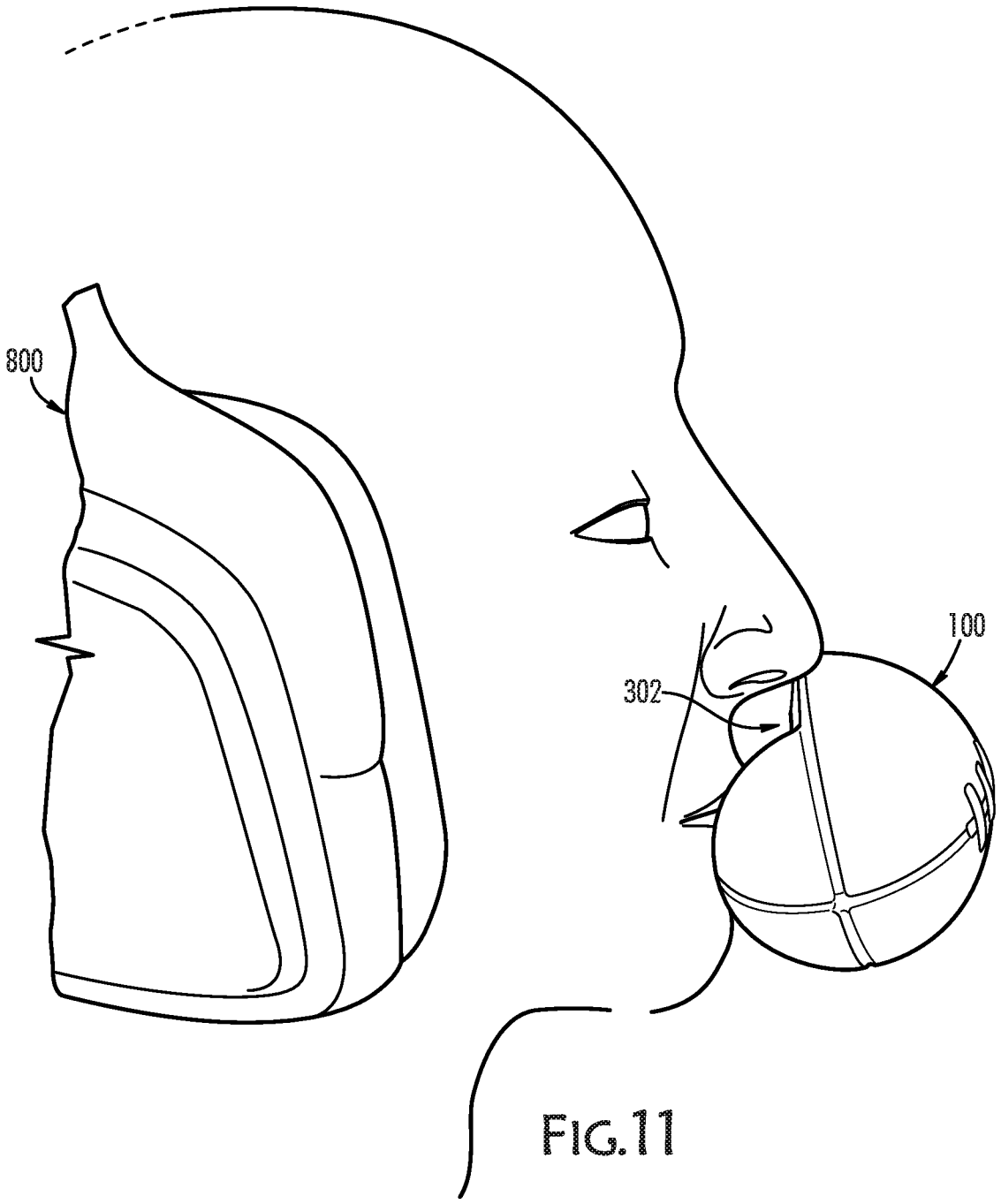
FIG. 11 is a right view of a mouthguard apparatus of FIG. 1 in an exemplary use, in accordance with an exemplary embodiment of the invention.

FIG. 11 is a right view of the mouthguard apparatus 100 in an exemplary use with a typical communications headset 800, in accordance with an exemplary embodiment of the invention.

Figure 12:
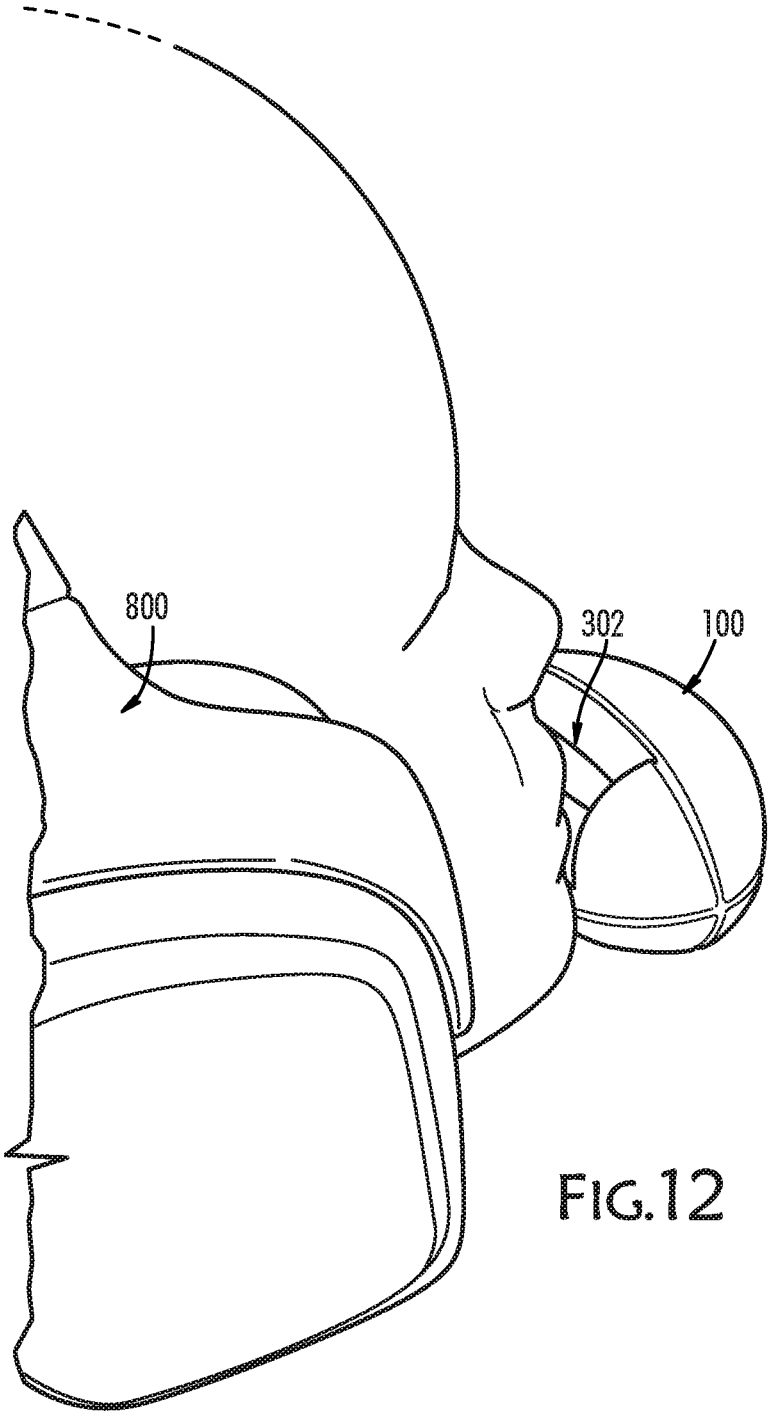
FIG. 12 is a rear perspective view of a mouthguard apparatus of FIG. 1 in an exemplary use, in accordance with an exemplary embodiment of the invention.

FIG. 12 is a rear perspective view of the mouthguard apparatus 100 in an exemplary use with a typical communications headset 800 which shows the cavity 302, in accordance with an exemplary embodiment of the invention.

Figure 13A:
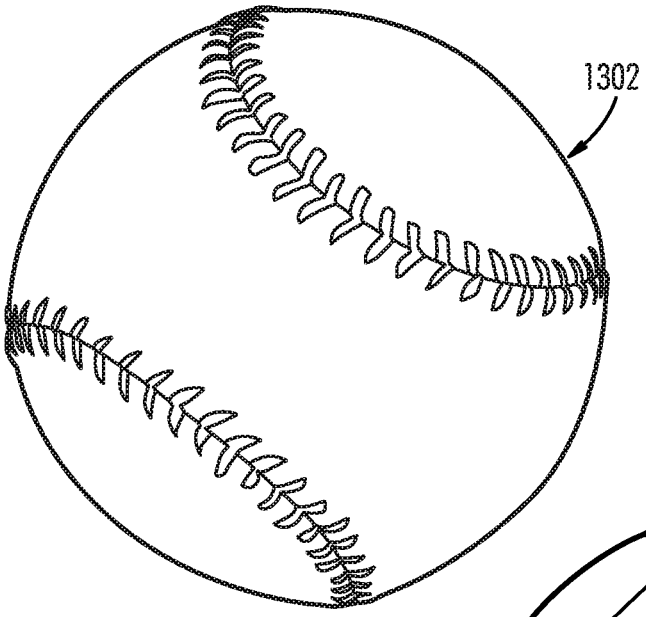
FIG. 13A-13C are perspective views of alternative embodiments of a mouthguard apparatus, in accordance with exemplary embodiments of the invention.
Figure 13B:
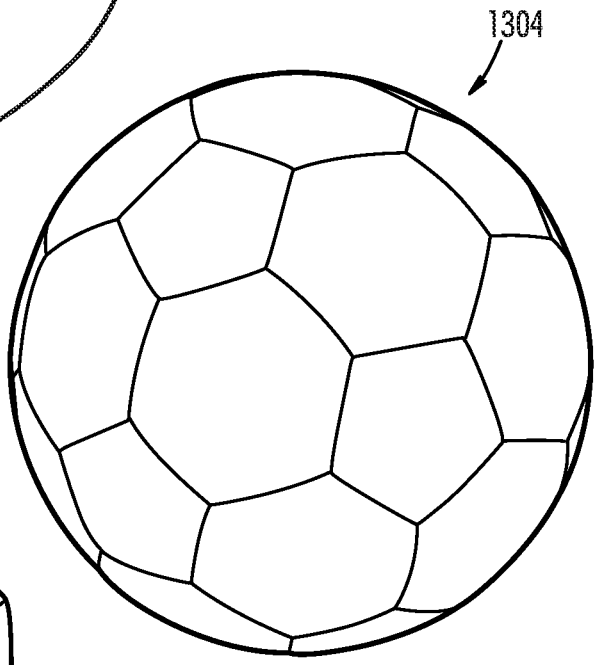
Figure 13C:
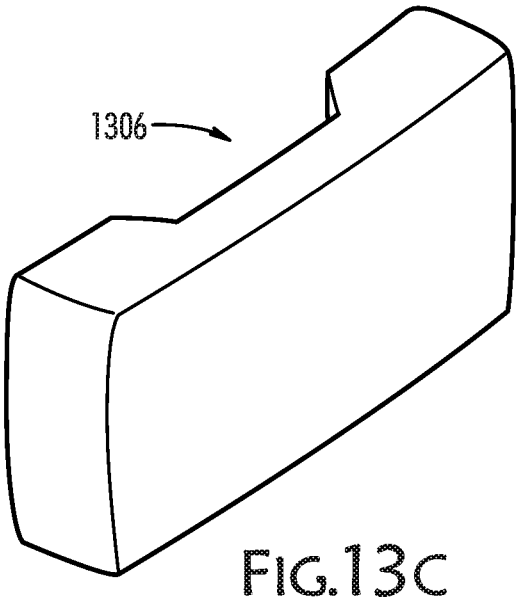

FIGS. 13A-13C show perspective views of alternative embodiments of a mouthguard apparatus, including a baseball 1302 configuration, a soccer ball 1304 configuration and a rectangular 1306 configuration, in accordance with exemplary embodiments of the invention. As described elsewhere herein, these are just exemplary shapes, and that the mouthguard apparatus 100 could exhibit any shape sufficient for covering the mouth of the user such that the user's lips cannot be read by an observer.

Figure 14A:
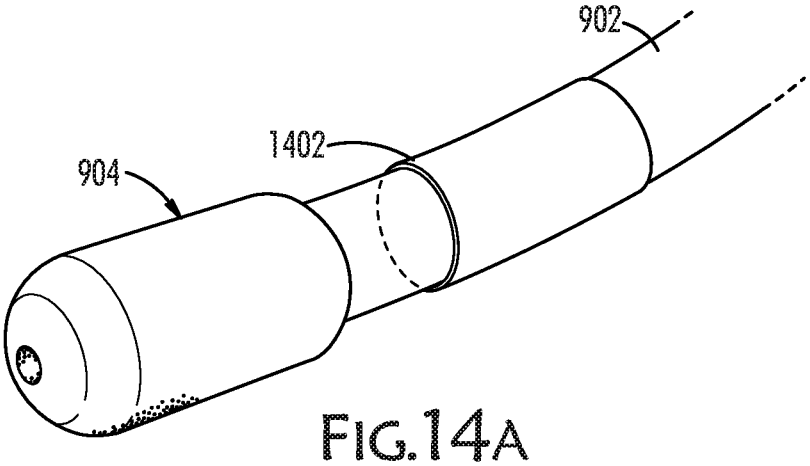
FIGS. 14A-14C are perspective views of exemplary attachment mechanisms, in accordance with exemplary embodiments of the invention.
Figure 14B:
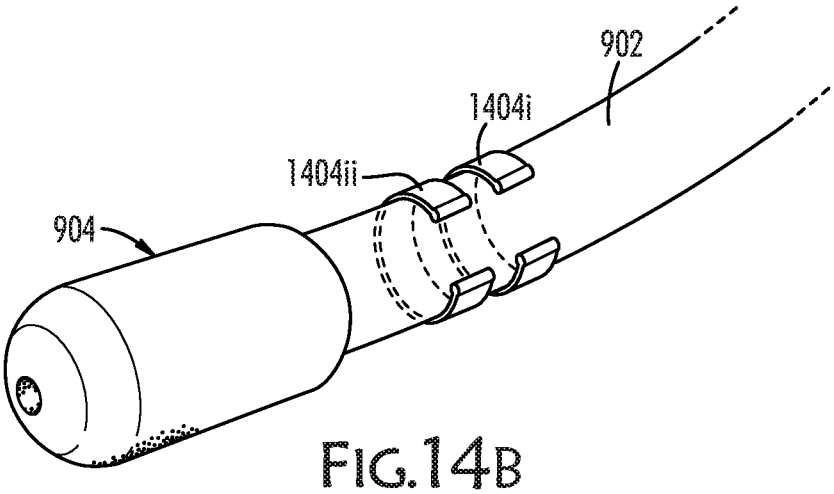
Figure 14C:
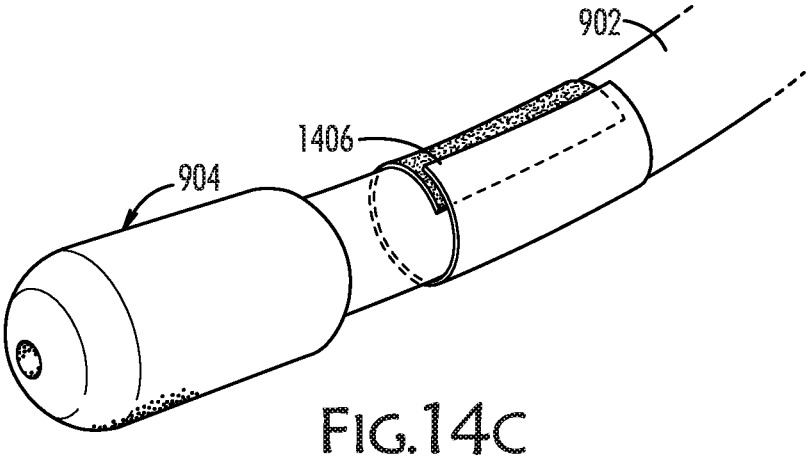
Figure 15A:
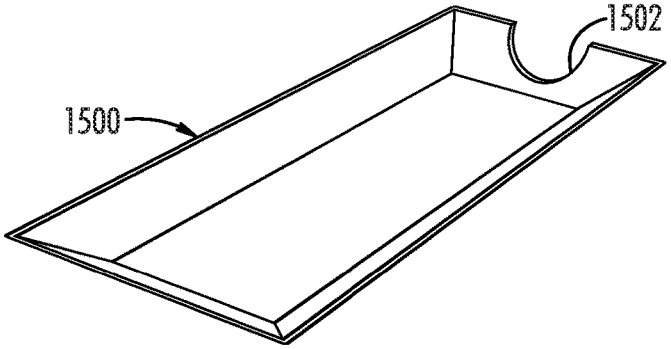
FIGS. 15A-15E are perspective, right/left, front, top, and bottom views of a tray, in accordance with exemplary embodiments of the invention.
Figure 15B:
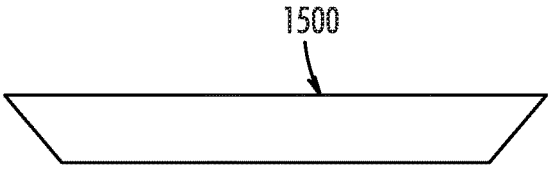
Figure 15C:
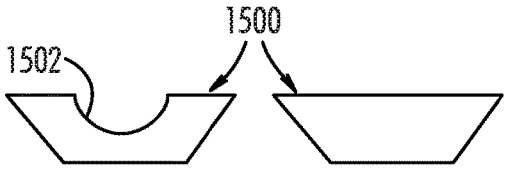
Figure 15D:
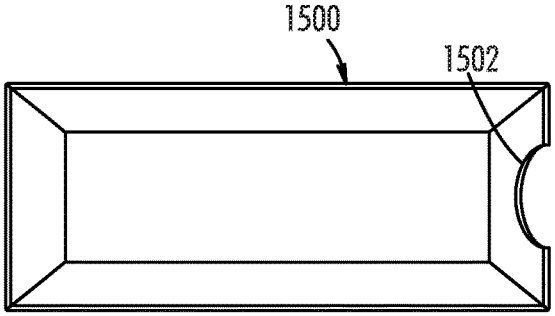
Figure 15E:
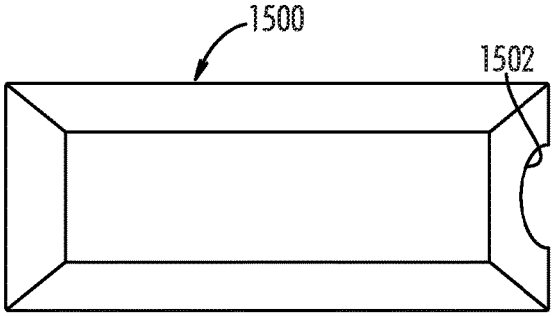

FIGS. 14A-14C are perspective views of exemplary attachment mechanisms, in accordance with exemplary embodiments of the invention. It should be understood that the tightness of the attachment mechanisms is optionally adjustable so that the microphone boom 902 positioning relative to the user's mouth can be adjustable. FIG. 14A shows a tubular attachment mechanism 1402, which is located inside the apparatus 100 and through which the microphone boom 902 is inserted to secure the apparatus 100 onto the headset 800. In an embodiment of the invention, the microphone boom 902 is advanced through the tubular attachment mechanism 1402 such that the microphone 904 extends into the cavity 302. In some embodiments, the tubular attachment mechanism 1402 is flexible or stretchy (and of a slightly smaller diameter then the boom 902) so that when the microphone boom 902 is located in the tubular attachment mechanism 1402, the boom 902 is gripped, or at least slightly compressed, by the tubular attachment mechanism 1402 to provide for a snug fit.

FIG. 14B shows a C-clip attachment mechanism wherein one or more C-clips, for example a first C-clip 1404*i* and a second C-clip 1404*ii*, is used to hold the microphone boom 902 within the apparatus 100. In some embodiments, the boom 902 is merely inserted through the C-clips. In some embodiments, the C-clips 1404*i*, 104*ii* actually snap around the boom 902, holding it tightly. As with other embodiments, the microphone 904 is ideally disposed within the cavity 302 when the boom 902 is properly inserted through the C-clip attachment mechanism.

FIG. 14C shows a strap attachment mechanism 1406 wherein the microphone boom 902 is either inserted into and through the strap attachment mechanism 1406 which has already been closed, or which is subsequently closed around the boom 902, for example by reversibly removing a rear portion of the apparatus 100 to access the strap attachment mechanism 1406. The strap attachment mechanism 1046 can be reversibly and/or adjustably closed using, for example, hook and pile fasteners, tongue-in-slot, snaps, and the like.

While not shown, the apparatus 100 could also be constructed or manufactured with an integral pocket/glove for insertion, and holding, of the microphone boom 902 therein.

FIGS. 15A-15E are perspective (FIG. 15A), right/left (FIG. 15B), front/back (FIG. 15C), top (FIG. 15D), and bottom (FIG. 15E) views of a tray 1500, in accordance with exemplary embodiments of the invention. In an embodiment of the invention, the tray 1500 is sized and shaped to be inserted into the cavity 302, to provide better acoustics for the microphone 904 located therein and/or structural support to the apparatus 100. In an embodiment of the invention, a cut-out 1502 is provided to one side of the tray 1500 in order to accommodate the passage of the microphone boom 902 therethrough. As described elsewhere with respect to the lumen, the cut-out 1502 could be disposed on either side of the tray 1500, or even on both sides, which is why both sides are referenced by the same Figure number.

Figure 16:
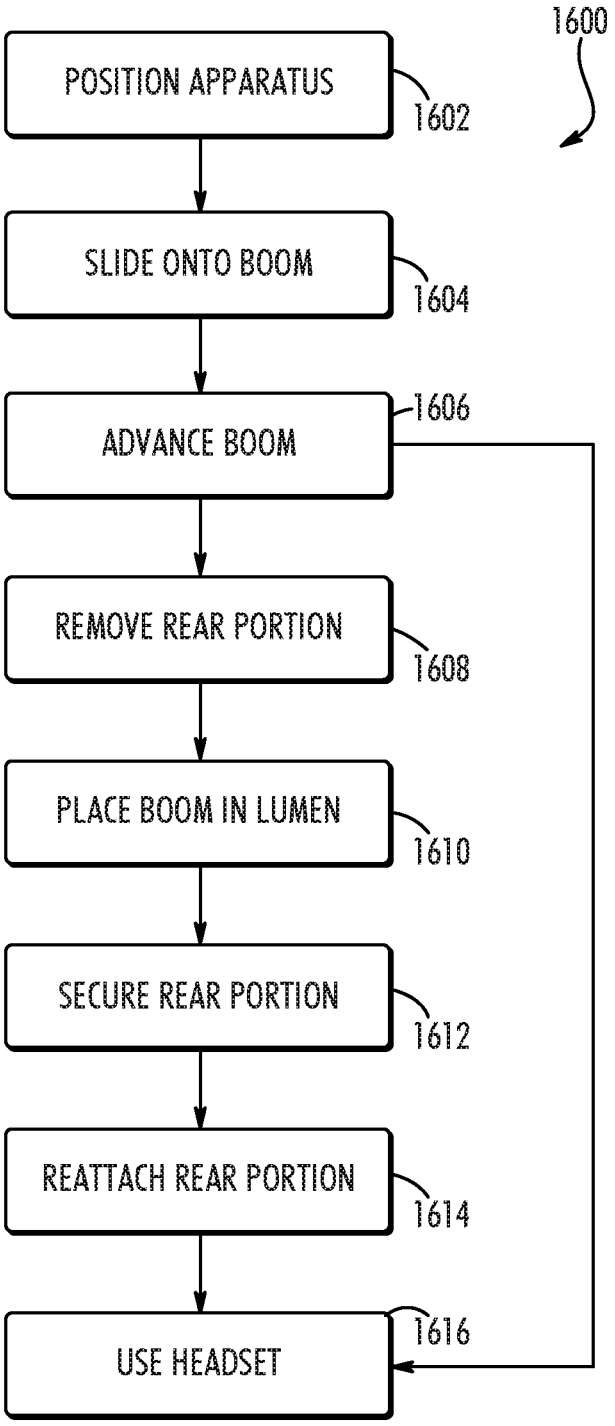
FIG. 16 is a flowchart of a method of using a mouthguard apparatus, in accordance with exemplary embodiments of the invention.

FIG. 16 is a flowchart 1600 of a method of using a mouthguard apparatus 100, in accordance with exemplary embodiments of the invention. In an embodiment of the invention, the mouthguard apparatus 100 is positioned (1602) proximally to the communications headset 800 such that the lumen 202 is near the microphone boom 902. The apparatus 100 is then slid (1604) onto the microphone boom 902 and is advanced (1606) such that the microphone 904 is disposed within the cavity 302 of the apparatus 100. The user then uses (1616) the headset 800 as normal, however, with the user's lips being wholly or substantially covered, such that the user's lips cannot be read while having normal conversation.

In some embodiments of the invention, instead of sliding 1604 the microphone boom 902 into the apparatus 100, a rear portion of the apparatus 100 is reversibly removed (1608) and the boom 902 is placed (1610) within the lumen 202 such that the microphone 904 is disposed within the cavity 302, and then an attachment mechanism is reversibly secured (1612) around the boom 902. The rear portion is then reattached (1614) to the apparatus 100 and the headset 800 is used (1616) as normal.

Figure 17:
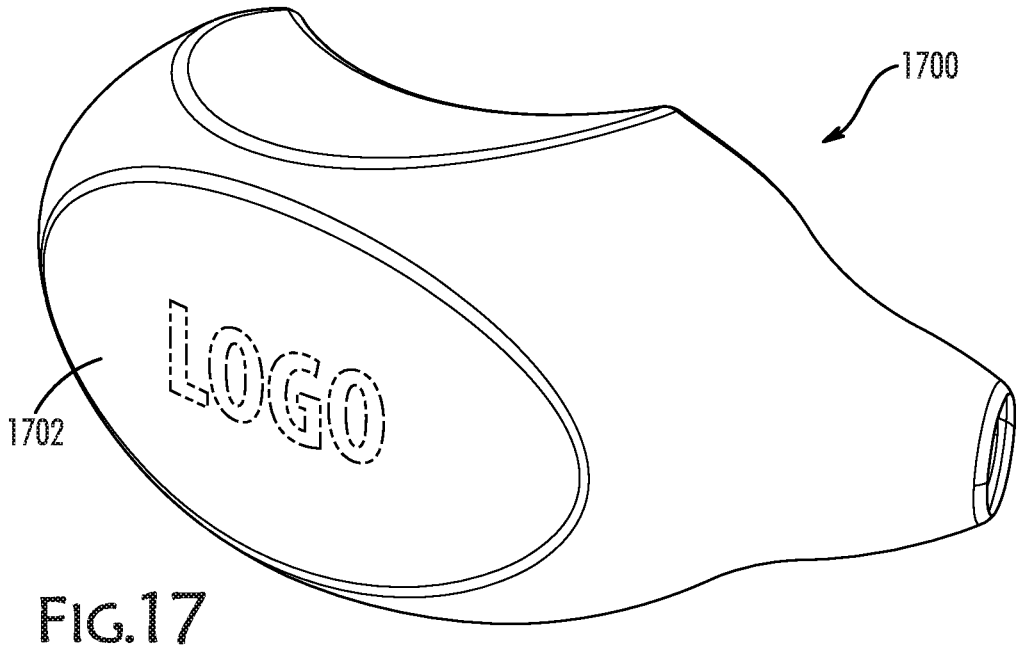
FIG. 17 is a front perspective view of a mouthguard apparatus, in accordance with an exemplary embodiment of the invention.

FIG. 17 is a front perspective view of a mouthguard apparatus 1700, in accordance with an exemplary embodiment of the invention. The mouthguard apparatus 1700 is configured with a flattened front surface 1702 for providing a "canvas" for displaying a logo (such as a team, league and/or company) and/or marketing/advertising material. As discussed elsewhere herein, the surface 1702 could be of a solid color for use with green-screen technology, for conveniently changing what is displayed on the surface 1702 during a broadcast.

Figure 18:
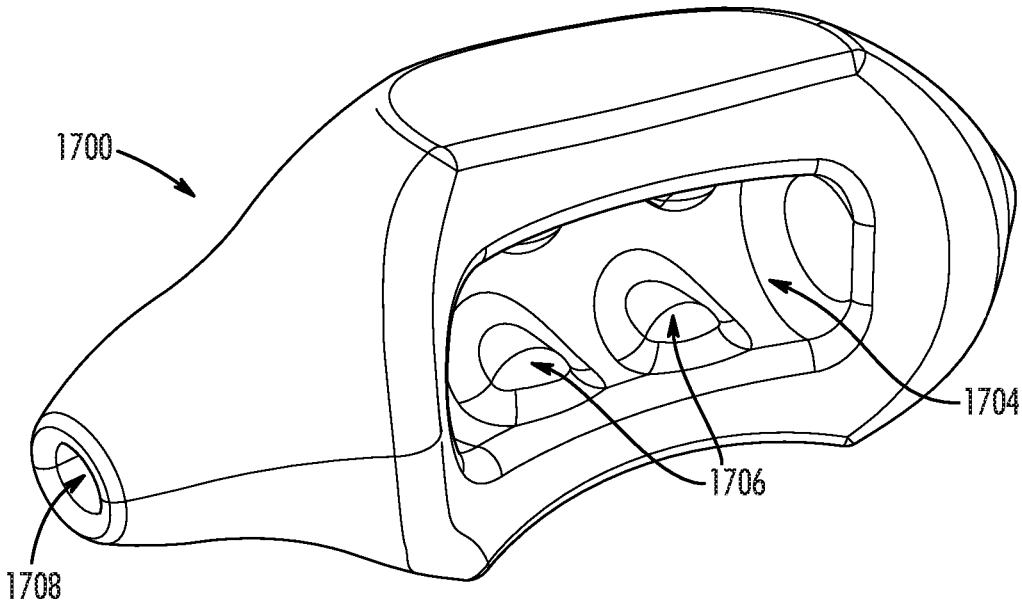
FIG. 18 is a rear perspective view of a mouthguard apparatus, in accordance with an exemplary embodiment of the invention.

FIG. 18 is a rear perspective view of the mouthguard apparatus 1700, in accordance with an exemplary embodiment of the invention. In an embodiment of the invention, the mouthguard 1700 is provided with a cavity 1704 which is formed on the inside with features 1706 which can be used for optimizing acoustics and/or for holding a microphone and/or boom therein. That is, the features perform at least two simultaneous functions, in some embodiments of the invention. It should be understood that any apparatus described herein with a cavity could have similar adaptations. Also shown in FIG. 18 is a lumen 1708 for insertion of a microphone boom therein.

Figure 19A:
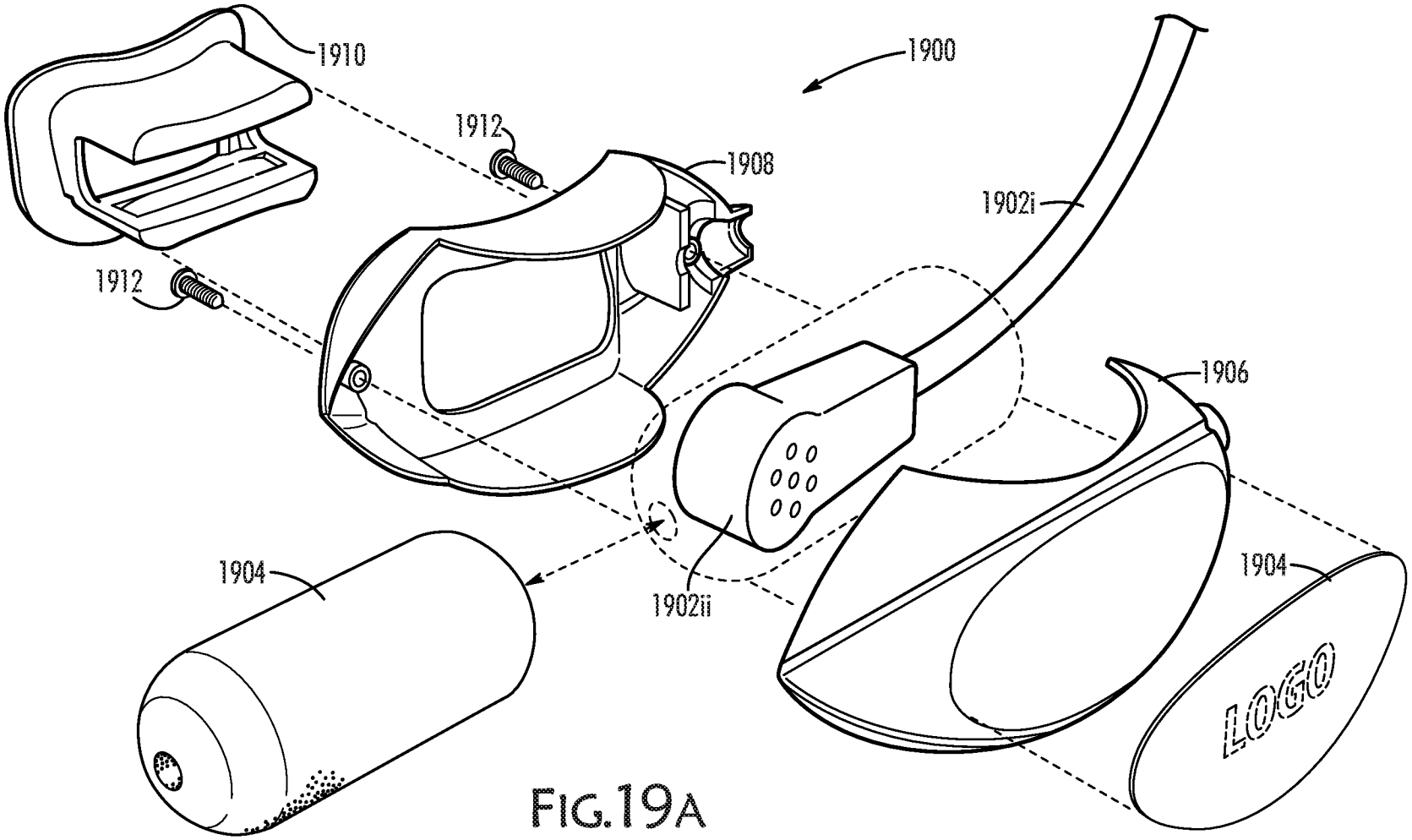
FIG. 19A is a front exploded view of a mouthguard apparatus, in accordance with an exemplary embodiment of the invention.

FIG. 19A is a front exploded view of a mouthguard apparatus 1900, in accordance with an exemplary embodiment of the invention. A microphone boom 1902*i*, including a microphone 1902*ii* on the distal end of the boom 1902*i*, is encapsulated by mouthguard apparatus 1900, wherein the apparatus 1900 comprises a plurality of components, including a buffer 1904, a front piece 1906, a rear piece 1908, a cavity frame 1910, connectors 1912 and/or a messaging attachment 1914. It should be understood that this assemblage of components is by way of example and the apparatus 1900 may not necessarily include some or all of these components. For example, instead of or in addition to the screws depicted in FIG. 19A as connectors 1912, an adhesive or snaps could be used. Further, in some embodiments the buffer 1904 and/or the cavity frame 1910 and/or the messaging attachment 1914 is not used.

Figure 19B:
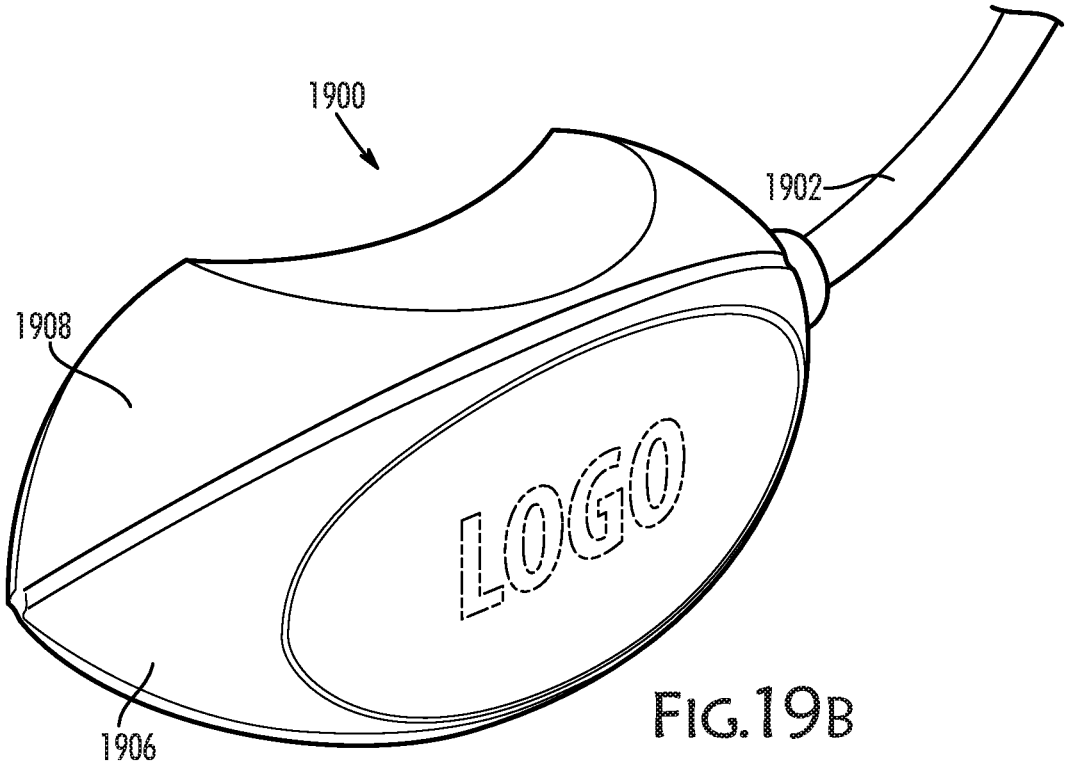
FIG. 19B is a front perspective view of an assembled mouthguard apparatus, in accordance with an exemplary embodiment of the invention.
Figure 20A:
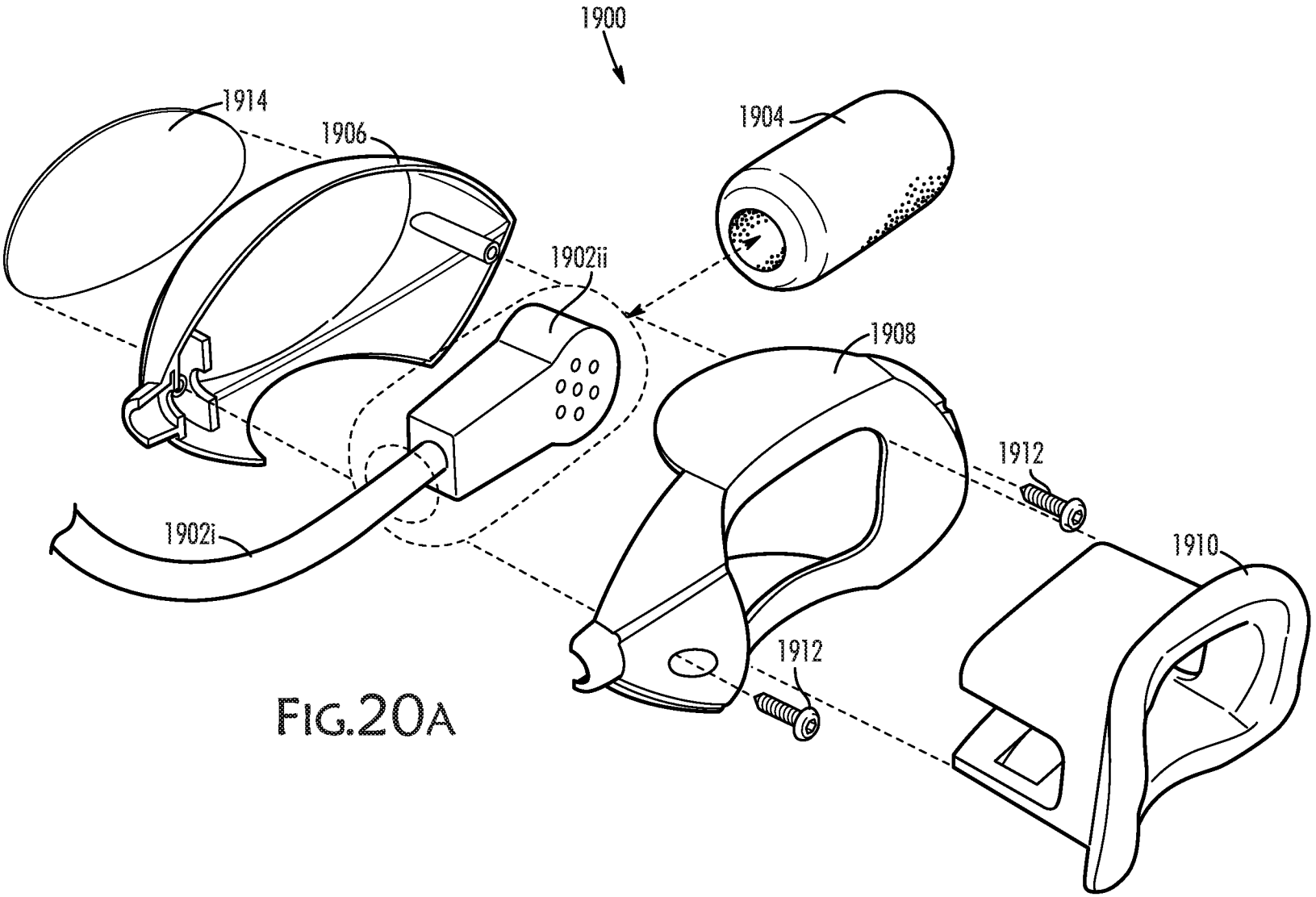
FIG. 20A is a rear exploded view of a mouthguard apparatus, in accordance with an exemplary embodiment of the invention.
Figure 20B:
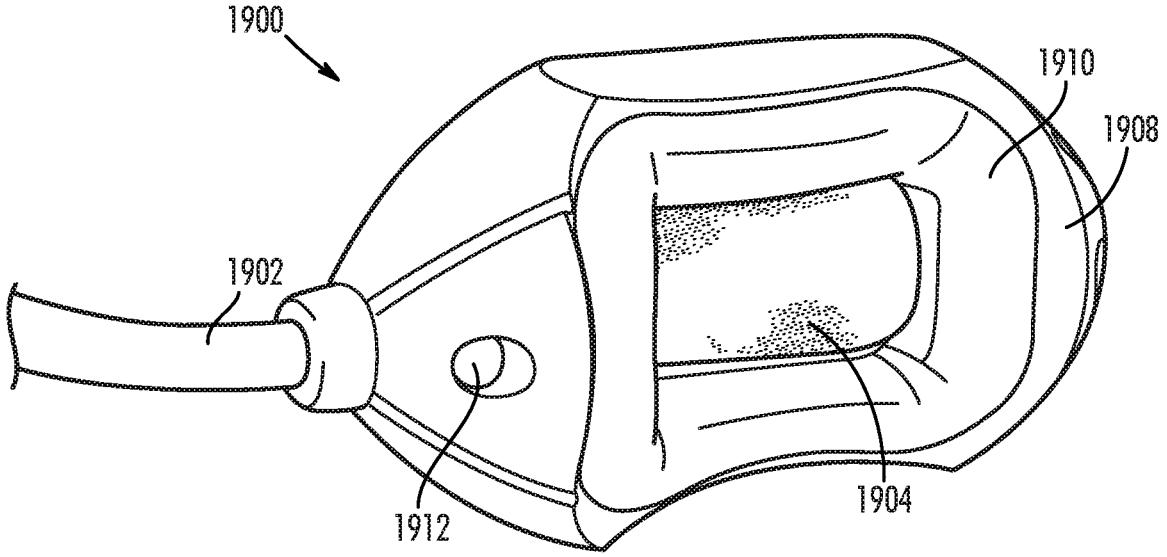
FIG. 20B is a rear perspective view of an assembled mouthguard apparatus, in accordance with an exemplary embodiment of the invention.

FIG. 19B is a front perspective view of an assembled mouthguard apparatus 1900, in accordance with an exemplary embodiment of the invention. FIGS. 20A-20B show mouthguard apparatus 1900 from the rear perspective.

Figure 21A:
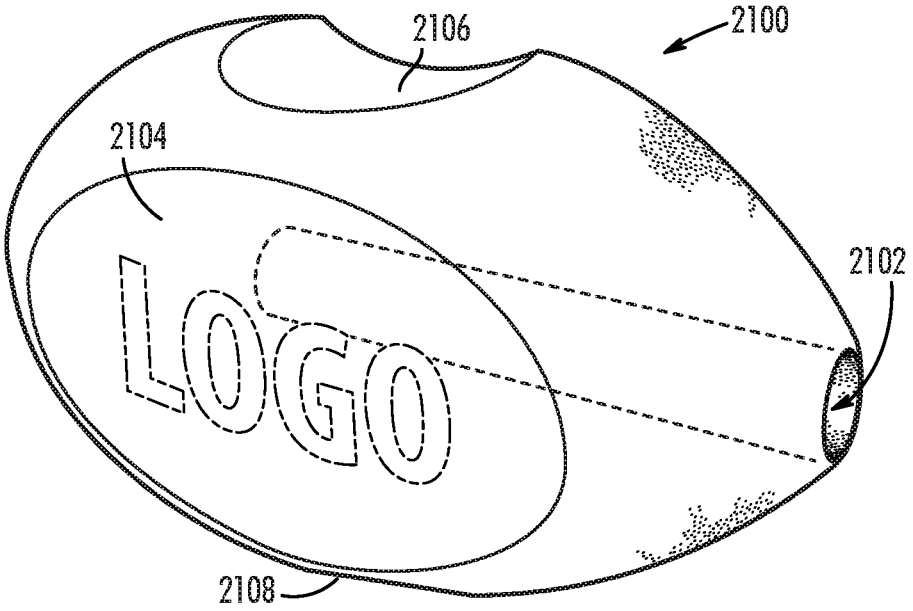
FIG. 21A is a front perspective view of a mouthguard apparatus, in accordance with an exemplary embodiment of the invention.

FIG. 21A is a front perspective view of a mouthguard apparatus 2100, in accordance with an exemplary embodiment of the invention. In an embodiment of the invention, the mouthguard apparatus 2100 comprises a body of unitary construction. In some embodiments of the invention, the mouthguard apparatus is made of a lightweight, foam-like material, for example urethane-based material. The mouthguard apparatus 2100 is formed with a lumen 2102 sized and shaped for the insertion of a microphone boom therein. The lumen 2102 extends into the interior of the apparatus 2100 (shown in more detail in FIG. 21C) such that a microphone of the microphone boom would be placed approximately in the center of the apparatus 2100 and, in an embodiment of the invention, in front of a mouth of a user of the apparatus 2100. In an embodiment of the invention, the cross-section of the lumen 2102 is substantially round shaped. Optionally, the cross-section of the lumen is shaped like a square or a triangle. Optionally, the cross-section of the lumen is ovoid or rectangular. In some embodiments of the invention, the lumen is custom or irregularly shaped to suit a specific type of microphone boom.

The apparatus 2100 is provided with a substantially flat front fascia for the placement of messaging thereon, such as team, league and/or company logos and/or advertising and/or other visually perceptible communications. Optionally, the front fascia is not substantially flat.

The apparatus 2100 is also provided with at least one dimple on the top 2106 and/or the bottom 2108 for providing a space for the user's nose and/or chin. In some embodiments of the invention, the dimples are positioned where they are because it is understood that the microphone might be of larger diameter than the boom, so when the microphone is in the middle of the mouthguard apparatus 2100 it will cause the central portion to swell, the dimples swelling out to create a more uniform shape of the apparatus 2100 (e.g. a football-shape). It is also conceived that the dimples are usable as grips on the apparatus 2100.

Figure 21B:
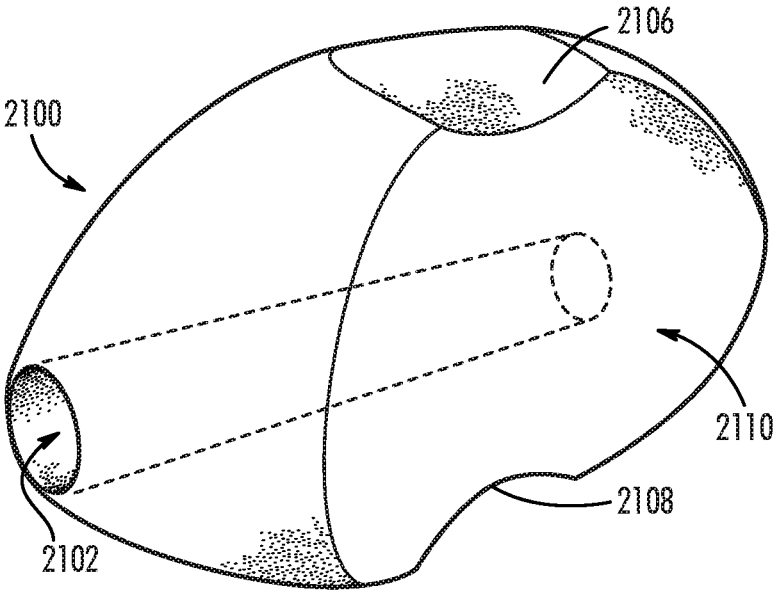
FIG. 21B a back perspective view of a mouthguard apparatus, in accordance with an exemplary embodiment of the invention.

FIG. 21B a back perspective view of the mouthguard apparatus 2100, in accordance with an exemplary embodiment of the invention. This perspective shows the indentation 2110 which is shaped to accommodate the user's mouth and/or the shape of the user's face when the apparatus 2100 is installed on a microphone boom.

Figure 21C:
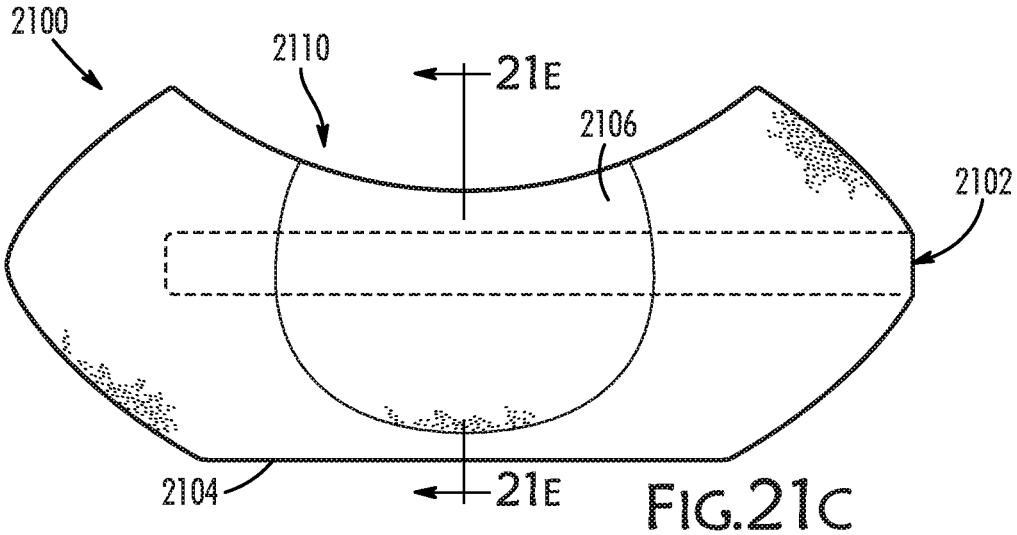
FIG. 21C a top view of a mouthguard apparatus, in accordance with an exemplary embodiment of the invention.
Figure 21D:
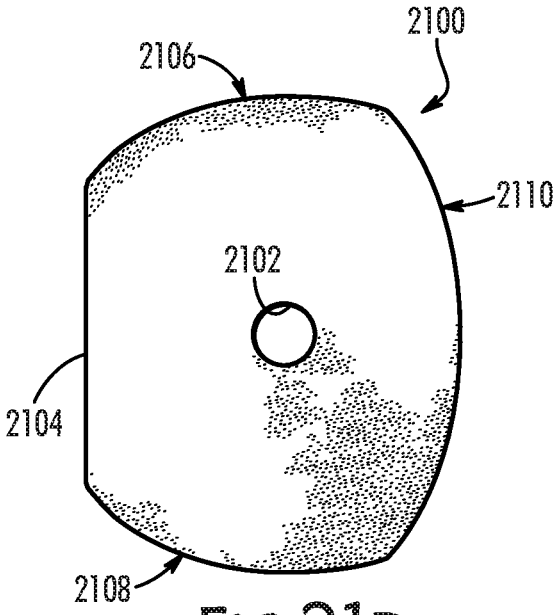
FIG. 21D side view of a mouthguard apparatus, in accordance with an exemplary embodiment of the invention; and, FIG. 21E is a cross-sectional view of a mouthguard apparatus in accordance with an exemplary embodiment of the invention.
Figure 21E:
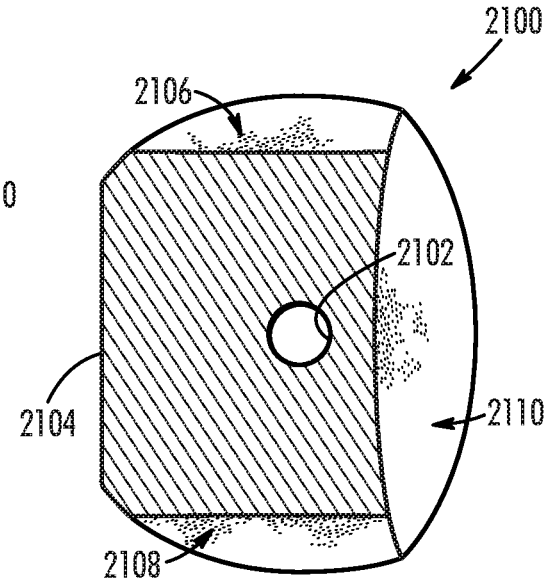

FIG. 21C a top view of the mouthguard apparatus 2100, in accordance with an exemplary embodiment of the invention. Shown in dashed lines is the lumen 2102 which partially traverses the interior apparatus 2100 such that when a microphone boom is inserted into the lumen 2102, the microphone portion of the microphone boom is positioned approximately in the center of the apparatus 2100. For example, the lumen 2102 extends at least partially past the middle of the apparatus 2100 so the microphone is near the middle. Optionally, the lumen 2102 extends between 0-20 mm past the midpoint of the apparatus 2100. Optionally, the lumen 2102 extends even greater than 20 mm from the midpoint. Another view of the lumen 2102 is shown in FIG. 21E. In an embodiment of the invention, the diameter of the lumen 2102 is sized slightly smaller than the microphone boom's diameter so that the apparatus 2100 is held onto the microphone boom at least by a compression fit. In some embodiments of the invention, the lumen has a diameter between 6 mm to 20 mm. In some embodiments, the lumen 2102 is not circular, for example it could be square, triangular, ovoid, formed to a specific microphone boom shape and the like. Adhesive and/or other fastening devices could also be used to secure the apparatus 2100 onto the microphone boom, although in an embodiment of the invention, the apparatus 2100 is easily attachable and removable from the microphone boom before and after use, respectively, by sliding the microphone boom through the lumen 2102 and then back out again. FIG. 21D side view of the mouthguard apparatus 2100, in accordance with an exemplary embodiment of the invention, showing an entrance of the lumen 2102 in more detail.

It is expected that during the life of a patent maturing from this application many relevant microphone headsets will be developed and the scope of the terms "microphone", "microphone boom" and "headset" are intended to include all such new technologies a priori.

It is expected that during the life of a patent maturing from this application many relevant image projection technologies will be developed and the scope of the term "greenscreen" is intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. For example, the apparatus shown in FIGS. 21-A-D, has a lumen only and no separate cavity feature, which could be a configuration applied to any of the other apparatus embodiments described herein. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A mouthguard apparatus for providing confidential communications for a user of a headset, comprising:

a body of unitary construction, wherein the body includes a) a lumen traversing from a side of the body at least to midway through the body, wherein the lumen extends past midway through the body, b) a curved indentation disposed on a back of the body, wherein the indentation is concave relative to the body, and c) at least one dimple on a top and/or a bottom of the body, extending generally transverse to the indentation on the back of the body.

2. The mouthguard according to claim 1, wherein the body further includes a flat front fascia on a side opposite the curved indentation.

3. The mouthguard according to claim 2, further comprising text and/or at least one design on the flat front fascia.

4. The mouthguard according to claim 2, wherein the flat front fascia is a solid color.

5. The mouthguard according to claim 1, wherein the body is shaped like at least one of a football, a rugby ball, a sphere, a rectangle, an ovoid and a cube.

6. The mouthguard according to claim 1, wherein the body is made from a compressible and/or elastic material.

7. The mouthguard according to claim 6, wherein the body is made from a urethane-based material.

8. The mouthguard according to claim 1, wherein a cross-section of the lumen is circular, triangle, square, rectangular, ovoid or irregularly shaped.

9. The mouthguard according to claim 1, wherein the lumen has a diameter between 6 mm and 20 mm.

10. The mouthguard according to claim 1, wherein the body has a length of 100 mm-150 mm.

11. The mouthguard according to claim 1, wherein the body has a width of 40 mm-90 mm.

12. A mouthguard apparatus for providing confidential communications for a user of a headset, comprising:

a body sized and shaped to substantially cover a mouth of the user;

a cavity disposed within the body;

a lumen disposed on a side of the body and passing through to the cavity from the side, and, a tray sized and shaped for insertion into the cavity wherein the tray further comprise a cut-out positioned proximally to the lumen when inserted into the cavity.

13. The mouthguard apparatus according to claim 12, further comprising an attachment mechanism.

14. The mouthguard apparatus according to claim 12, further comprising a removable rear portion.

15. The mouthguard apparatus according to claim 12, wherein the body includes at least one of text and a design on the front.

16. The mouthguard apparatus according to claim 12, further comprising at least one feature within the cavity shaped and sized to enhance acoustics within the cavity and/or hold a portion of the headset securely.

17. A method of using a mouthguard apparatus with a headset including a microphone on a microphone boom, comprising:

positioning the mouthguard apparatus proximally to the communications headset, such that a lumen of the mouthguard apparatus is near the microphone boom;

sliding the mouthguard apparatus onto the microphone boom; and, advancing the microphone boom into the mouthguard apparatus such that the microphone is located within a cavity of the mouthguard apparatus, wherein there is at least one dimple on a top and/or a bottom of the body, extending generally transverse to the indentation on the back of the body.

18. A method of using a mouthguard apparatus with a headset including a microphone on a microphone boom, comprising:

positioning the mouthguard apparatus proximally to the communications headset, such that a lumen of the mouthguard apparatus is near the microphone boom;

removing a rear portion of the mouthguard apparatus;

placing the microphone boom within the lumen such that the microphone is disposed within the cavity;

securing an attachment mechanism around the boom;

re-attaching the rear portion to the mouthguard apparatus; and, using the headset.

* * * * *